US005740892A

United States Patent [19]

Huang

[11] Patent Number: 5,740,892

[45] Date of Patent: Apr. 21, 1998

[54] POWER WRENCH TORQUE TRANSMISSION MECHANISM

[76] Inventor: Chen Shu-Hsia Huang, 8F, No. 472, Sec. 3, Ming-Chih Road, Tai-Shan Hsiang, Taipei Hsien, Taiwan

[21] Appl. No.: 703,103

[22] Filed: Aug. 26, 1996

[51] Int. Cl.[6] ..... B25B 15/00

[52] U.S. Cl. ..... 192/43.1; 81/54; 173/93; 173/179

[58] Field of Search ..... 192/43.1, 104 R, 192/104 B; 173/176, 179, 93; 81/54, 57.14

[56] References Cited

U.S. PATENT DOCUMENTS

| | | | |
|---|---|---|---|
| 2,898,791 | 8/1959 | Maurer | 173/93 |
| 3,006,446 | 10/1961 | Harrison et al. | 173/93 X |
| 3,175,660 | 3/1965 | Kaman | 173/93 X |
| 3,605,914 | 9/1971 | Kramer | 173/93 |
| 4,727,780 | 3/1988 | Huang | 81/54 |
| 4,920,831 | 5/1990 | Huang | 81/54 |
| 4,947,939 | 8/1990 | Hung | 173/179 |
| 5,035,161 | 7/1991 | Huang | 81/54 |
| 5,379,851 | 1/1995 | Huang | 173/179 |
| 5,412,546 | 5/1995 | Huang | 173/176 X |

*Primary Examiner*—Rodney H. Bonck

[57] ABSTRACT

A torque transmission mechanism to be used in a power wrench includes a body driven by a motor, having a central bore to rotatably support therein a toothed end of an output shaft. The toothed end of the shaft has a pair of diametrically opposite teeth, each defined by two circumferentially opposite contact faces that extend along radii of the output shaft. The body has a radial notch communicating the bore with a coupling member pivotally received therein. The coupling member has two opposite wings alternately movable into the bore with the rotation thereof to selectively engage one of the teeth for driving the shaft. A centrifugal clutch is provided between the body and the motor to control the movement of the wings. The control comprises two pins movable between an engagement position where the pins engage the coupling member and prevents the wings of the coupling member from moving into the bore and a disengagement position where the pins disengage from the coupling member and the coupling member is allowed to rotate freely. The pins have circumferential grooves to be loosely received within open slots provided on the clutch, while maintaining the pins thereon, to accommodate sideways force applied thereto so as to increase the service life thereof.

7 Claims, 5 Drawing Sheets

POWER WRENCH TORQUE TRANSMISSION MECHANISM

FIELD OF THE INVENTION

The present invention relates generally to a power wrench which is capable of applying torque impulse to loose/tighten the wheel stub in an intermittent fashion and in particular to a torque transmission mechanism for the power wrench.

BACKGROUND OF THE INVENTION

Power wrenches for loosening/tightening stud nuts or bolt by applying intermittent torque thereto are known. Examples are U.S. Pat. Nos. 4,727,780, 4,920,831, 4,947,939, 5,035,161 and 5,412,546, Japanese patent publication No. 7-42617 and Japanese utility model No. 3017657, Chinese patent Nos. 24796 and 213255, Canadian patent Nos. 1,245,482 and 2,030,473, Australian patent No. 589089 and Taiwanese patent Nos. 34467 and 62327. All these patents are related to power wrenches comprising a hollow body coupled to a motor to be driven thereby, a coupling member having two opposite wings pivoted to the body and rotatable relative thereto to have either one of the wings swing into the body, an output shaft having a toothed end rotatably and substantially co-axially received within the body to be engaged by the wings of the coupling member so as to drive the output shaft to transmit torque to a tool, such as a socket, secured to an opposite end of the shaft and a clutch to control the engagement between the wings and the toothed end of the output shaft so as to generate an intermittent torque output at the output shaft.

Among these known patents, U.S. Pat. No. 5,412,546 is a particularly good design. The design of this U.S. patent, however, still has some drawbacks in the torque transmission mechanism thereof and can be further improved. It is therefore desirable to provide a power wrench, based on the teaching of U.S. Pat. No. 5,412,546 with further improvement to overcome the drawbacks of the prior patent.

SUMMARY OF THE INVENTION

The principal object of the invention is to provide a power wrench torque transmission mechanism comprising improvements over the known device of U.S. Pat. No. 5,412,546 by providing the output shaft with a double-faced tooth configuration so as to improve the working efficiency of the teeth of the output shaft, as compared to single-faced configuration teeth adapted in the '546 patent.

It is another object of the present invention to provide a torque transmission mechanism wherein the control pins that are driven by the centrifugal clutch to control the torque impulse output of the output shaft are loosely connected to the centrifugal clutch so as to accommodate sideways force applied thereto and thus increase the service life thereof as compared to the completely fixed control pins adapted in the prior art.

In accordance with the present invention, there is provided a power wrench torque transmission mechanism, comprising a body driven by a motor and having a central bore to rotatably support therein a toothed end of an output shaft. The toothed end of the shaft has a pair of diametrically opposite teeth, each defined by two circumferentially opposite contact faces that extend along radii of the output shaft. The body has a radial notch communicating the bore with a coupling member pivotally received therein. The coupling member has two opposite wings alternately movable into the bore with the rotation thereof to selectively engage one of the teeth for driving the shaft. A centrifugal clutch is provided between the body and the motor to control the movement of the wings. The control comprises two pins movable between an engagement position where the pins engage the coupling member and prevents the wings of the coupling member from moving into the bore and a disengagement position where the pins disengage from the coupling member and the coupling member is allowed to rotate freely. The pins have circumferential grooves to be loosely received within open slots provided on the clutch, while maintaining the pins thereon, to accommodate sideways force applied thereto so as to increase the service life thereof.

BRIEF DESCRIPTION OF THE DRAWINGS

The present invention will be better understood from the following description of a preferred embodiment of the present invention, with reference to the attached drawings, wherein.

DETAILED DESCRIPTION OF THE PREFERRED EMBODIMENT

Figure 1:
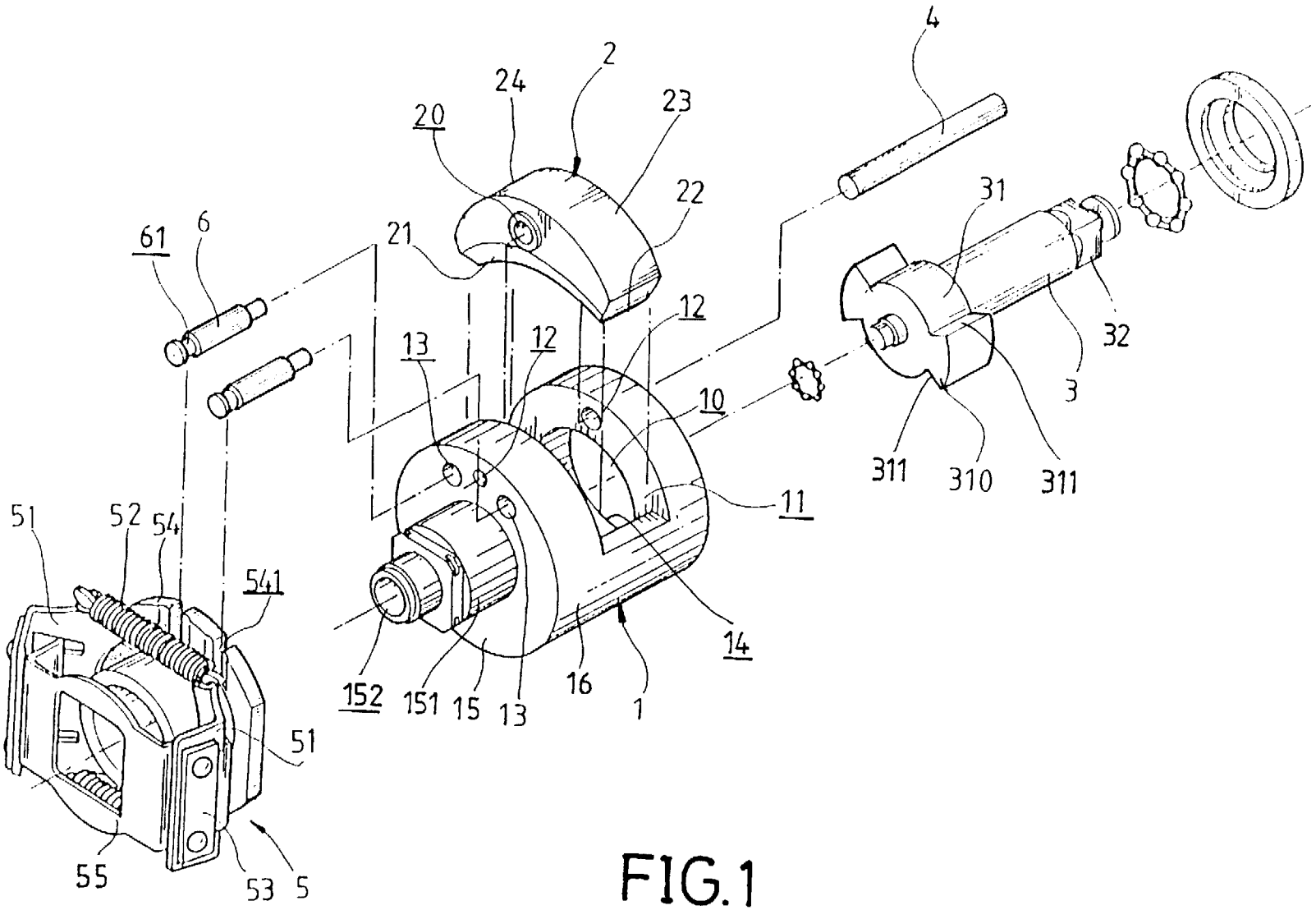
FIG. 1 is an exploded perspective view showing a power wrench torque transmission mechanism in accordance with the present invention.

With reference to the drawings and in particular FIG. 1, wherein a power wrench torque transmission mechanism constructed in accordance with the present invention is shown, the power wrench torque transmission mechanism of the present invention, which will be abbreviated "the mechanism" hereinafter, is generally housed in a housing (not shown) to be driven by a motor (not shown) which is also housed within the housing under the control of a user-actuateable switch (not shown). The mechanism comprises a hollow cylindrical main body 1, having a central bore 10 with an open end 14 and a closed end 15 connected together by a cylindrical circumferential side wall 16. A projection 151, preferably cylindrical, is co-axially or concentrically mounted to the closed end 15 of the main body 1 with a central hole 152 extending therethrough to receive and fix to a spindle of the motor (not shown) so as to be rotatable with the motor spindle for transmitting torque/rotation from the motor to the main body 1.

The main body 1 comprises a radial notch 11 formed on the side wall 16 and in communication with the central bore 10 to loosely receive therein a coupling member 2 of complemental shape and size. A pivot pin 4 extends through holes 12 formed on the main body 14 at axially opposite edges of the notch 11 and a hole 20 formed on the coupling member 2 to freely rotatably support the coupling member 2 within the notch 11. The hole 20 is formed on a central portion of the coupling member 2 with two opposite wings 23 and 24 extending laterally from the central portion of the coupling member 2 where the hole 20 is located.

Preferably, each of the wings 23 and 24 has a remote end edge 22 which points into the central bore 10. The free rotation of the coupling member 2 about the pivot pin 4 allows the end edge 22 of either one of the wings 23 and 24 to move from a neutral position where the coupling member 2 is substantially flush with the side wall 16 of the main body 1 and thus the end edges 22 are located substantially symmetrical with respect to the main body 1 so as to form a continue cylindrical surface with the cylindrical side wall 16 of the main body 1 toward a working position where the end edge 22 of one of the wings 23 and 24 is moved into the central bore 10.

The coupling member 2 also has an inclined side surface 21 formed on one side thereof facing the closed end 15 of the main body 1 and extending from the end edge 22 of one of the wings 23 and 24 to the edge 22 of the other wing.

The open end 14 of the main body 1 receives an output shaft 3 to extend into the central bore 10 of the main body 1 so that an expanded end 31 of the output shaft 3 is rotatably supported within the central bore 10 of the hollow cylindrical main body 1 and substantially registered with the notch 11 and the coupling member 2. The output shaft 3 has an opposite, driving tip end 32 extending out of the wrench housing and adapted to engage and drive a tool, such as a socket.

The expanded end 31 of the output shaft 3 comprises a pair of teeth 310, preferably diametrically opposite to each other and each comprising a double-faced configuration that comprises two circumferentially opposite contact faces 311 substantially extending along radii of the output shaft 3. The teeth 310 are shaped and sized so as to be rotatable within the central bore 10 of the main body 1 when the coupling member 2 is in the neutral position, but engageable by the end edge 22 of one of the wings 23 and 24 of the coupling member 2 by the contact engagement between one of the faces 311 and the end edge 22 when the coupling member 2 is rotated relative to the main body 1 to the working position where the one of the end edges 22 is moved deeply into the central bore 10.

The double-faced configuration of the teeth 310 of the output shaft 3 provides the advantage that once the end edges 22 of the coupling member 2 miss one of the teeth 310, they may hit the contact face 311 of the other tooth 310 so that the working efficiency of the power wrench may be increased as compared to the conventional design wherein the teeth have only one contact face.

Figure 2:
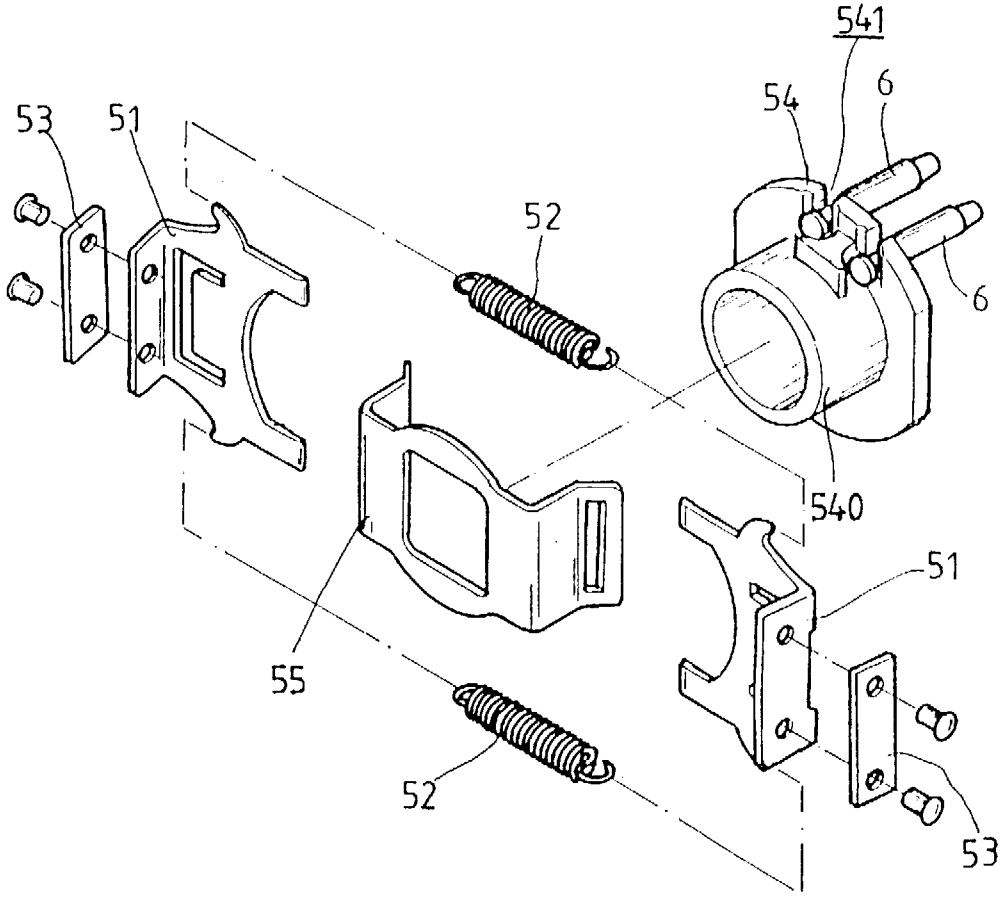
FIG. 2 is an exploded perspective view showing a centrifugal clutch adapted in the power torque transmission mechanism of the present invention.
Figure 3:
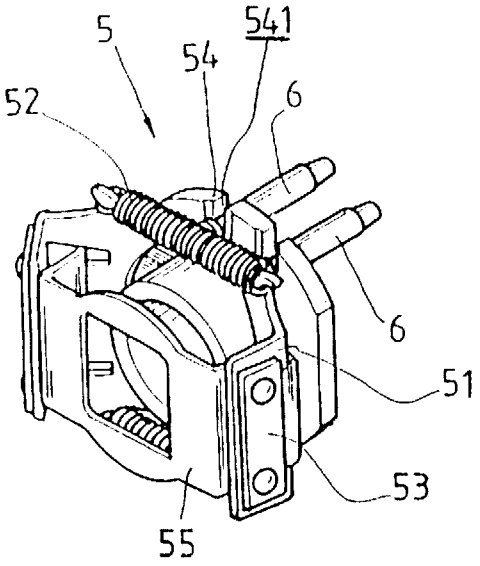
FIG. 3 is a perspective view of the centrifugal clutch of FIG. 2.

A centrifugal clutch 5 is mounted to the projection 151 of the closed end 15 of the main body 1. As best seen in FIGS. 2 and 3, the centrifugal clutch 5 comprises a disk-like member 54 having a first surface facing the closed end 15 of the main body 1 on which at least a control pin 6 is fixed to point toward the closed end 15 of the main body 1. It is preferable to have two such control pins 6 fixed on the disk 54 as illustrated in the specific embodiment shown in the drawings.

The disk 54 also has a second surface facing away from the closed end 15 of the main body 1 on which a cylinder 540 is formed to be movably or slidably fit over the projection 151 of the main body 1.

To mount the control pins 6, the disk 54 has formed thereon an open slot 541 of a given width for each of the control pins 6. Each of the control pins 6 has formed on an end thereof a circumferential groove 61, see FIG. 1, which has an outer diameter substantially corresponding to the width of the open slot 541 to be loosely and thus movably receivable therein with an opposite free end of the control pin 6 pointing toward the closed end 15 of the main body 1. Preferably, a pre-determined clearance is provided between the circumferential groove 61 of each of the control pins 6 and the width of the respective open slot 541 of the disk 54. This allows the control pins 6 to accommodate sideways forces applied thereto during the operation of the wrench so as to elongate the service life thereof.

Figure 4:
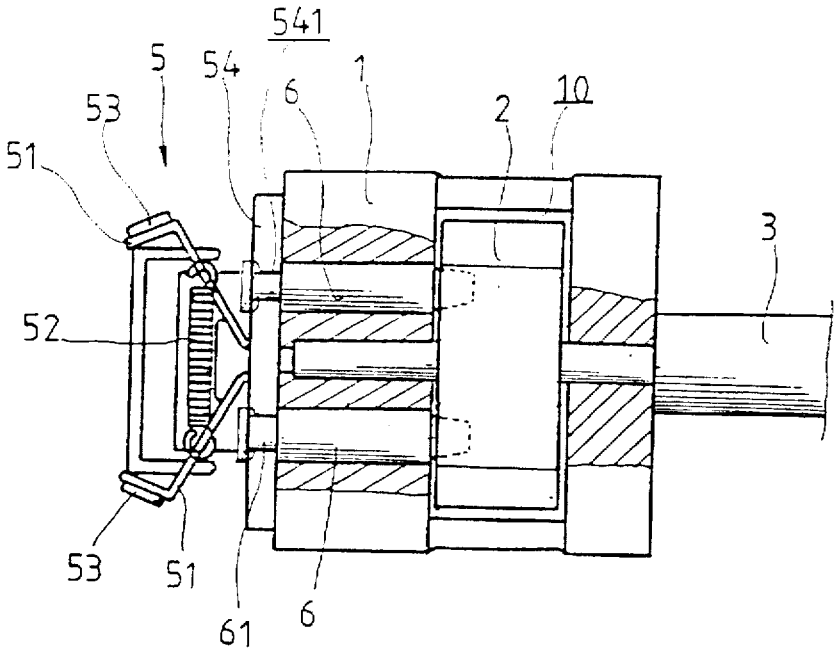
FIGS. 4 and 5 are top views, partially broken, respectively showing the engagement and disengagement of the control pins with the coupling member of the power wrench torque transmission mechanism of FIG. 1.
Figure 5:
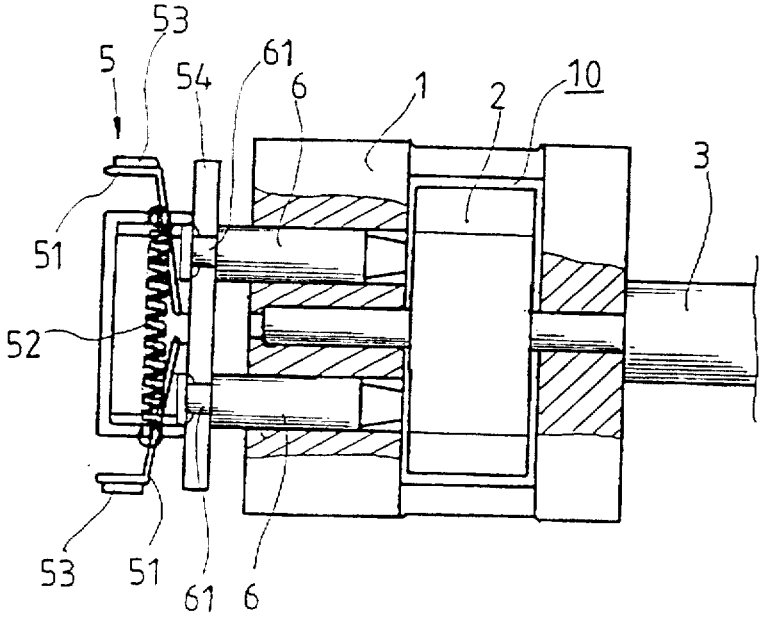
Figure 6:
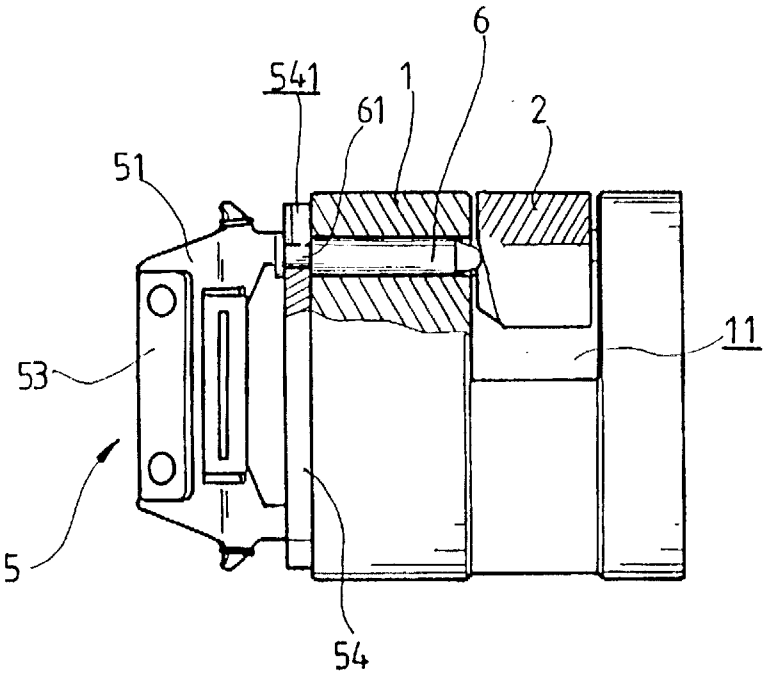
FIGS. 6 and 7 are side elevational views, partially broken, showing the engagement and disengagement of the control pins with the coupling member, respectively associated with FIGS. 4 and 5.
Figure 7:
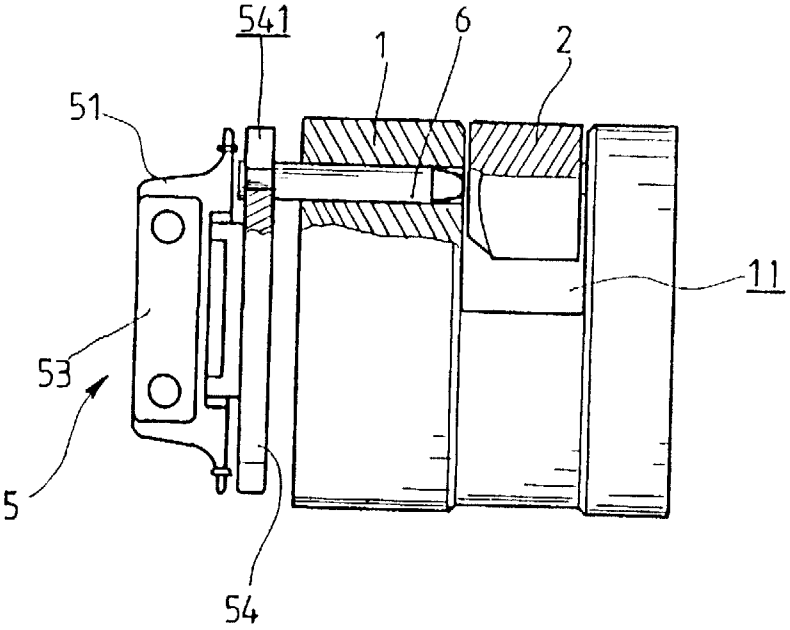

The closed end 15 of the main body 1 has holes 13 formed thereon and corresponding in position to the control pins 6 so that when the disk 54 of the clutch 5 is movably fit over the projection 151, the control pins 6 are received within the holes 13 to be movable, by the movement of the disk 54 relative to the projection 151, between an engaging position where the free ends of the control pins 6 extend out of the holes 13 and enter the notch 11 to be located closely under and in contact engagement with the inclined side surface 21 of the coupling member 2 and thus prevent the coupling member 2 from rotation relative to the main body 1 and maintain the coupling member 2 at the neutral position thereof, as shown in FIGS. 4 and 6, and a disengaging position where the control pins 6 are withdrawn into the holes 13 and disengage from the inclined side surface 21 of the coupling member 2 and thus forming no constraint to the rotation of the coupling member 2, as shown in FIGS. 5 and 7.

Preferably, the free ends of the control pins 6 are tapered to facilitate their movement into contact engagement with the inclined side surface 21 of the coupling member 2 and helping forcing the wings 23 and 24 to move from the working position back to the neutral position by the camming engagement therebetween.

The centrifugal clutch 5 further comprises a base plate 55 fixed to the projection 151 of the main body 1 with two movable members 51 movably attached thereto. Each of the movable members B1 is rotatably supported on the base plate 55 with a pair of helical springs 52 are arranged between the two movable members 51 to bias the movable members 51 toward each other. Each of the movable members 51 also has an end in contact engagement with the disk 54 so that when the movable members 51 are rotated relative to the base plate 55 away from each other, the disk 54 is allowed to move relative to the projection 151 of the main body 1 and thus moving the control pins 6 to disengage from the coupling member 2.

Each of the movable members 51 has a weight 53 fixed thereon which when rotated in a high speed generates a force to move the movable members 51 against the helical spring 52 with the centrifugal force acting thereupon.

In operation, since the centrifugal clutch 5 is fixed to the projection 151 of the main body 1, the rotational speed of the main body 1 generates a centrifugal force acting upon the weights 53 of the centrifugal clutch 5 to rotate the movable members 51 relative to the base plate 55 against the biasing force of the helical springs 52. Under this situation, the disk 54 is allowed to move relative to the cylindrical projection 151 of the main body 1 to disengage the control pins 6 from the coupling member 2 (the disengaging position) and thus allowing the coupling member 2 to rotate relative to the main body 1, making one of the wings 23 and 24 move into the central bore 10 to hit and impact one of the teeth 310 of the output shaft 3 so as to transmit a torque impulse or rotation to the tool fixed to the driving tip end 32 of the output shaft 3 for performing loosening/tightening operation.

On the other hand, once the driving tip end 32 is engaged with a nut or bolt, the rotation of the output shaft 3 is stopped by the reaction torque from the nut or bolt to be loosened/tightened. Under this situation, the biasing force of the helical springs 52 becomes greater than the centrifugal force provided by the rotation of the weights 53 so as to force the disk 54 and the control pins 6 to move toward the main body 1 and thus the control pins 6 enter into the notch 11 toward the engaging position, forcing the coupling member 2 back to the neutral position thereof. The rotation of the output shaft 3 then resumes due to the disengagement of the coupling member 2 from the teeth 310 of the output shaft 3. The repeated high speed and low speed cycle of the output shaft 3 will continue until the nut or bolt is tightened or loosened.

It is apparent that although the invention has been described in connection with the preferred embodiment, it is contemplated that those skilled in the art may make changes to the preferred embodiment without departing from the scope of the invention as defined in the appended claims.

What is claimed is:

1. A torque transmission mechanism comprising a cylindrical main body having a central bore surrounded by a cylindrical side wall with a closed end adapted to connect to a motor and an open end to receive and rotatably support a toothed end of an output shaft within the central bore, the main body comprising a radial notch in communication with the central bore to receive and rotatably support therein a coupling member, the coupling member comprising two wings opposite to each other and alternately movable into the central bore to selectively engage and drive the toothed end of the output shaft, the coupling member further comprising an inclined side surface, a centrifugal clutch mounted to the main body and having at least one control pin coupled thereto to be movable by the centrifugal clutch between a first position where the at least one control pin engages the inclined side surface of the coupling member to prevent the wings of the coupling member from moving into the central bore and engaging the toothed end of the output shaft and a second position where the at least one control pin disengages from the coupling member to allow the wings to move into the central bore to engage the toothed end of the output shaft, wherein the at least one control pin comprises a circumferential groove located at one end thereof and the centrifugal clutch comprises an open slot having a width sufficient to loosely receive the circumferential groove of the at least one pin therein to have a second opposite end of the at least one control pin pointing toward the inclined side surface of the coupling member.

2. The mechanism as claimed in claim 1, wherein the centrifugal clutch comprises two control pins and two corresponding open slots to respectively loosely receive the control pins therein.

3. The mechanism as claimed in claim 1, wherein the toothed end of the output shaft comprises two radially extending teeth, each comprising two circumferentially opposite and radially extending contact faces.

4. The mechanism as claimed in claim 3, wherein the two teeth are arranged to be diametrically opposite to each other.

5. A torque transmission mechanism comprising a cylindrical main body having a central bore surrounded by a cylindrical side wall with a closed end adapted to connect to a motor and an open end to receive and rotatably support a toothed end of an output shaft within the central bore, the toothed end of the output shaft comprising two radially extending teeth, each defined by two circumferentially opposite and radially extending contact faces, the main body comprising a radial notch in communication with the central bore to receive and rotatably support therein a coupling member, the coupling member comprising two wings opposite to each other and each having a remote end edge alternately movable into the central bore to selectively engage and drive the toothed end of the output shaft, the coupling member further comprising an inclined side surface, a centrifugal clutch mounted to the main body and having at least one control pin coupled thereto to be movable by the centrifugal clutch between a first position where the at least one control pin engages the inclined side surface of the coupling member to prevent the wings of the coupling member from moving into the central bore and engaging the toothed end of the output shaft and a second position where the at least one control pin disengages from the coupling member to allow the remote end edge of one of the wings to move into the central bore to engage one of the contact faces of one of the teeth of the toothed end of the output shaft, the at least one control pin comprising a circumferential groove located at one end thereof and the centrifugal clutch comprises an open slot having a width sufficient to loosely receive the circumferential groove of the at least one pin therein to have a second opposite end of the at least one control pin pointing toward the inclined side surface of the coupling member.

6. The mechanism as claimed in claim 5, wherein the centrifugal clutch comprises two control pins and two corresponding open slots to respectively loosely receive the control pins therein.

7. The mechanism as claimed in claim 5, wherein the two teeth are arranged to be diametrically opposite to each other.

* * * * *